United States Patent [19]

Stopp et al.

[11] 4,263,790

[45] Apr. 28, 1981

[54] METHOD FOR KNITTING AND SEVERING SYNTHETIC PILE LOOP FABRICS

[76] Inventors: Fritz Stopp, Thumber Str. 190; Heinz Lindner, Alte Hormersdorfer Str. B 22 g; Gerhard Haas, Bingeweg B 61; Werner Oehm, Bachstr. 248 B, all of 9307 Geyer/E, German Democratic Rep.

[21] Appl. No.: 775,334

[22] Filed: Mar. 7, 1977

Related U.S. Application Data

[63] Continuation of Ser. No. 659,460, Feb. 19, 1976, abandoned.

[30] Foreign Application Priority Data

Mar. 14, 1975 [DD] German Democratic Rep. ... 184771

[51] Int. Cl.[3] ..... D04B 23/08; D06C 13/08

[52] U.S. Cl. ..... 66/84 R; 26/9; 26/14; 51/299

[58] Field of Search ..... 26/8 R, 8 C, 9, 14; 66/83, 84 R; 51/299; 139/291 C

[56] References Cited

U.S. PATENT DOCUMENTS

| | | | |
|---|---|---|---|
| 447,226 | 2/1891 | Booth | 66/84 R |
| 857,356 | 6/1907 | Morton | 26/8 C |
| 1,969,497 | 8/1934 | Benner | 51/299 |
| 2,022,893 | 12/1935 | Martin | 51/299 |
| 2,177,940 | 10/1939 | Kistler | 51/299 X |
| 2,986,455 | 5/1961 | Sandmeyer | 51/299 X |
| 3,032,404 | 5/1962 | Douglass et al. | 51/299 X |
| 3,341,386 | 9/1967 | White et al. | 26/9 X |

FOREIGN PATENT DOCUMENTS

| | | | |
|---|---|---|---|
| 48-25390 | 7/1973 | Japan | 66/84 R |
| 136621 | 3/1930 | Switzerland | 26/9 |
| 1101 | of 1855 | United Kingdom | 26/8 R |
| 1157 | of 1856 | United Kingdom | 66/84 R |
| 4677 | of 1877 | United Kingdom | 26/8 R |

*Primary Examiner*—Robert Mackey
*Attorney, Agent, or Firm*—Nolte and Nolte

[57] ABSTRACT

Method of severing fibrous material, comprising contacting the fibrous material with a moving cutting member constituted of particles of an abrasive material and a high polymeric binder.

4 Claims, 5 Drawing Figures

METHOD FOR KNITTING AND SEVERING SYNTHETIC PILE LOOP FABRICS

This is a continuation of application Ser. No. 659,460 filed Feb. 19, 1976 now abandoned.

This invention relates to a method for severing yarns, threads, fibers or webs of preferably synthetic fibrous material. More particularly, the invention relates to a method for severing pile loops on warp knitting machines.

It is known in the production of plush materials on pile knitting machines or weaving looms, to use rotating steel cutters or knives for cutting open pile loops. These cutters or knives are subjected to a great deal of wear, particularly during the processing of synthetic yarn and, as a result, must be frequently re-ground, in order to function efficiently. Due to the large number of cutters required for pile knitting machines, this re-grinding process is relatively time-consuming and has an undesirable adverse effect upon the productivity of the pile knitting machine.

In order to eliminate this disadvantage, it has been previously known in the art to provide the cutters with plain or cylindrical ground edges or with concave ground edges, or to employ ice-hardened cutters.

However, these measures did not make a considerable contribution toward increasing the wear resistance of such cutters, and, in addition, entailed the disadvantage of much more expense in the manufacture of the cutters.

Accordingly, therefore, it is an object of the present invention to increase the wear resistance of the tools being utilized to sever textile yarns, threads, fibers or webs.

The primary object of the invention is to provide a simple and reliable method for severing textile yarns, threads, fibers or flat webs, which method eliminates, to a great extent, the maintenance of the severing tools.

To this end and in accordance with the invention, the yarns, threads, fibers or webs are cut or abraded apart by means of severing members that are substantially known from the metal cutting art and are comprised of a pressed or cast high polymer-filler mixture. Preferably, these severing members are constituted of hard rubber filled to the extent of 70 to 95% of the weight of the member with a fine-grained corundum and are operated at a peripheral speed relative to the material being cut of 1.5 m./s. to 3.0 m./s. By "fine-grained corundum" is generally meant corundum of particle sizes in the range of about 250 μm to about 80 μm.

For severing polyamide yarns, threads, fibers or webs, the peripheral speed of the severing members is 2.0 m./s. to 2.4 m./s.

The apparatus for performing the method of the invention is characterized in that slotted holders are provided for guiding the pile loops and a cutting disc according to the invention is provided for each pile loop holder, the cutting discs rotating in opposition to the take-up direction of the fabric, the outer edge of each cutting disc being received in the slot of a respective pile loop holder.

In accordance with another feature of the invention, the cutting discs are non-rotatably connected to a common drive shaft to rotate therewith and provided between each two adjacent cutting discs is a spacer, preferably made of high polymeric plastic.

The cutting discs each have an acute-angled cutting edge, having a preferred angle of 30° to 45°.

The cutting discs which are used according to the method of the invention have a much longer edge life than conventional steel cutters and, therefore, need much less re-grinding. This contributes greatly to the efficiency of the machine productivity, particularly in connection with the manufacture of plush goods on pile knitting machines.

In order that the invention may be readily carried into effect, it will now be described with reference to specific embodiments, as illustrated in the accompanying drawings, wherein.

Figure 3:
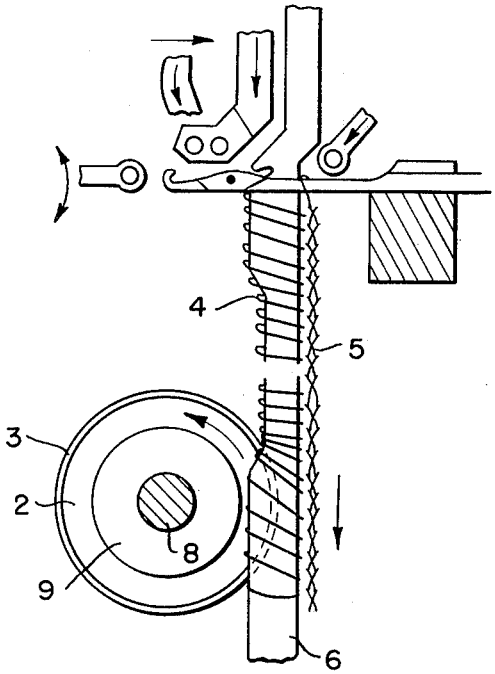
FIG. 3 is a front elevation of a severing apparatus according to the invention for severing the pile loops on a pile knitting machine.
Figure 3A:
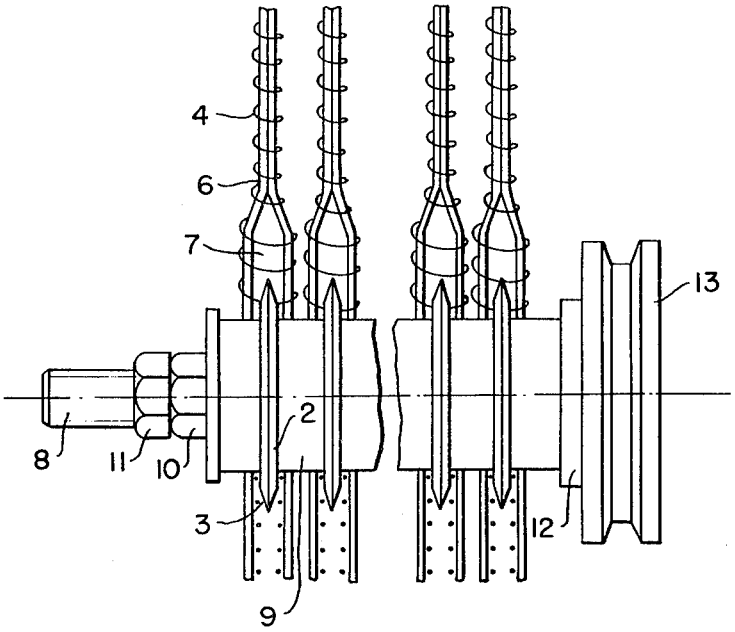

FIG. 3*a* is a partial side elevation of the apparatus of FIG. 3; and

Figure 4:
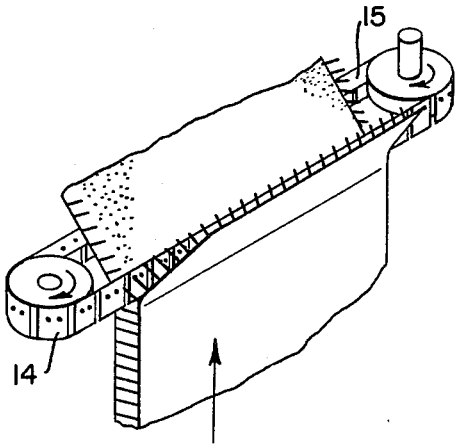

FIG. 4 is an isometric of another embodiment of a severing apparatus used according to the invention for severing double-faced fabric.

Figure 1:
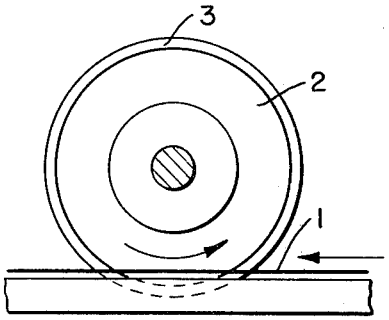
FIG. 1 is a front elevation of a severing apparatus used according to the present invention for severing textile webs.
Figure 2:
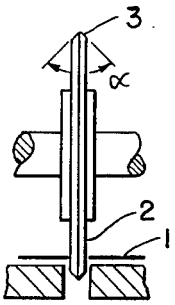
FIG. 2 is a lateral elevation of the apparatus of FIG. 1.

Referring now to the drawings, in FIGS. 1 and 2, a textile web 1 is delivered to a rotating cutting disc 2. The cutting disc 2 consists, preferably, of pressed hard rubber having a filler content of fine-grained standard corundum of a minimum of 70% to a maximum of 95% of the weight of the disc and rotates at a peripheral speed of approximately 1.5 m./s. to 3 m./s.

In order to obtain clean cut surfaces and to improve the cutting effect of the rotating disc 2, the cutting edge 3 is provided with an acute angle of, preferably, 30° to 45°.

FIG. 3 shows a section through the looping members of a pile knitting machine. For severing the pile loops 4, the fabric 5 is delivered by means of a conventional take-up roller (not shown in the drawings to the cutting discs 2, which rotate in opposition to the take-up direction. Each row of pile loops 4 runs along a respective two-part guide member 6, a so-called "pile loop holder". Each pile loop holder 6 is provided with a respective cutting disc 2, the cutting edge 3 of which is received in the slot 7 which is formed by the two parts of the holder 6. The cutting discs 2 are non-rotatably mounted on a common shaft 8 with a plastic spacer 9 being provided between each two adjacent cutting discs 2. The position of the cutting discs 2 is fixed by a nut 10 together with a locking nut 11, which press the cutting discs 2 and the spacers 9 against a rigid collar 12. The shaft 8 is driven by engagement of a motor driven belt (not shown) with a belt pulley 13 (FIG. 3*a*). For severing pile loops of multifilament texturized polyamide yarn, the peripheral speed of the cutting discs 2 is, preferably, 2.0 to 2.4 m./s. After more than 300 hours of use, the cutting discs show no signs of wear whatsoever and the cut surfaces of the pile loops appear uniform and clean.

For severing double-faced fabric, in accordance with FIG. 4, the cutting members are in the form of a plurality of individual small plates 14 which are fastened to a continuous conveyor means or belt drive 15.

While the invention has been described with reference to preferred embodiments thereof, it is intended that the claims also encompass variations and modifications of the preferred embodiments which would be obvious to those working in the art. For example, while the binder is, preferably, hard rubber and the abrasive material is preferably, fine-grained corundum, organic high polymers, such as organic polymeric plastics, alternatively may be used as binders and other abrasive materials, such as, abrasive metallic nitrides or diamond chips, alternatively may be used. While the invention is especially suitable for the severing of polyamide fibrous material, i.e., yarns, threads, fibers, fabrics and other webs, the invention is also applicable to the severing of other fibrous materials, such as fibrous materials comprised of natural fibers, polyesters and the like.

What we claim is:

1. A method of producing a pile material which comprises producing, from synthetic fiber, a fabric having a plurality of pile loops on a pile knitting machine, continuously delivering the fabric as it is produced through a pile severing zone and severing the loops cleanly and uniformly by abrading them with the outer periphery of a rotating grinding member constituted of particles of an abrasive material with a high polymeric binder, said abrasive member being rotated at a peripheral speed of between about 1.5 and about 3.0 meters per second relative to the pile yarn.

2. Method according to claim 1, in which the abrasive material is corundum and the binder is hard rubber, the corundum constituting 70 to 95% of the total weight of the corundum and hard rubber.

3. Method according to claim 1, in which the pile yarn is a polyamide and said speed of the abrasive member is 2.0 to 2.4 meters per second.

4. Method according to claim 1, in which the abrasive member has a grinding edge having an angle of 30 degrees to 45 degrees.

* * * * *